United States Patent [19]

Natalicio

[11] 4,226,459

[45] Oct. 7, 1980

[54] GELATIN CAPSULE HOLDER

[76] Inventor: John C. Natalicio, 2600 Griffith Park Blvd., Silverlake, Calif. 90039

[21] Appl. No.: 970,455

[22] Filed: Dec. 18, 1978

[51] Int. Cl.[3] ..... B25B 9/02

[52] U.S. Cl. ..... 294/99 R; 81/43; 294/33

[58] Field of Search ..... 294/11, 16, 28, 33, 294/99 R, 106; 81/43; 128/321, 354

[56] References Cited

U.S. PATENT DOCUMENTS

| | | | |
|---|---|---|---|
| 1,594,792 | 8/1926 | Mortimer | 294/33 X |
| 1,725,173 | 8/1929 | Anderson | 128/321 |
| 3,302,648 | 2/1967 | Nelson | 81/43 X |
| 3,628,818 | 12/1971 | Pittman | 294/28 X |
| 3,628,824 | 12/1971 | Leuw et al. | 294/99 R |

*Primary Examiner*—Johnny D. Cherry

*Attorney, Agent, or Firm*—Allan M. Shapiro

[57] ABSTRACT

Capsule-gripping jaws are positioned on the end of resilient arms. From the unflexed position, a capsule can be inserted into the jaws to be resiliently grasped and retained during scoop filling of the capsule. After filling, the capsule is released in the first and second preferred embodiments by flexure of the arms and, in another preferred embodiment, by pressing out the capsule by flexing a release arm.

7 Claims, 8 Drawing Figures

GELATIN CAPSULE HOLDER

BACKGROUND OF THE INVENTION

1. Field of the Invention

This invention is directed to a gelatin capsule holder by which a gelatin capsule is retained during scoop filling and thereupon is released.

2. Description of the Prior Art

Gelatin capsules are widely used in the dispensing of doses of dry powder and small pellet medication. In large volume factory operations, such capsules are machine-filled. However, when a druggist specially compounds a medication powder, he must individually fill the gelatin capsules by which the dosage is established and the medication is dispensed. Since the gelatin capsules are small, they are difficult to hold with the fingers during manual filling operations. Furthermore, the medication could become contaminated by such manual capsule filling. Thus, there is a need for a simple device which holds the gelatin capsule for manual manipulation for filling thereof and thereupon the capsule is released readily.

SUMMARY OF THE INVENTION

In order to aid in the understanding of this invention, it can be stated in essentially summary form that it is directed to a gelatin capsule holder having first and second arms, each carrying a capsule-grasping jaw with the arms resiliently holding the jaws in capsule-holding position. Capsule release means is provided and, in the first and second embodiments, comprises spreading of the jaw-carrying arms by flexure controlled by finger pressure; and, in the third preferred embodiment, comprises thrusting the capsule from the jaws by finger pressure flexure of a capsule-engaging release arm.

It is thus an object of this invention to provide a gelatin capsule holder by which the capsule can be held and manipulated during scooping motion of the capsule for capsule filling. It is a further object to provide a convenient holder by which a gelatin capsule can be held during manual scoop-filling thereof and from which the capsule can be conveniently released after capsule filling. It is a further object to provide a gelatin capsule holder wherein a gelatin capsule of standard dimensions is resiliently retained between jaws and where release means is provided to release the capsule upon the filling thereof.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figures 1, 2, 3, 4, 5, 6, 7, 8:
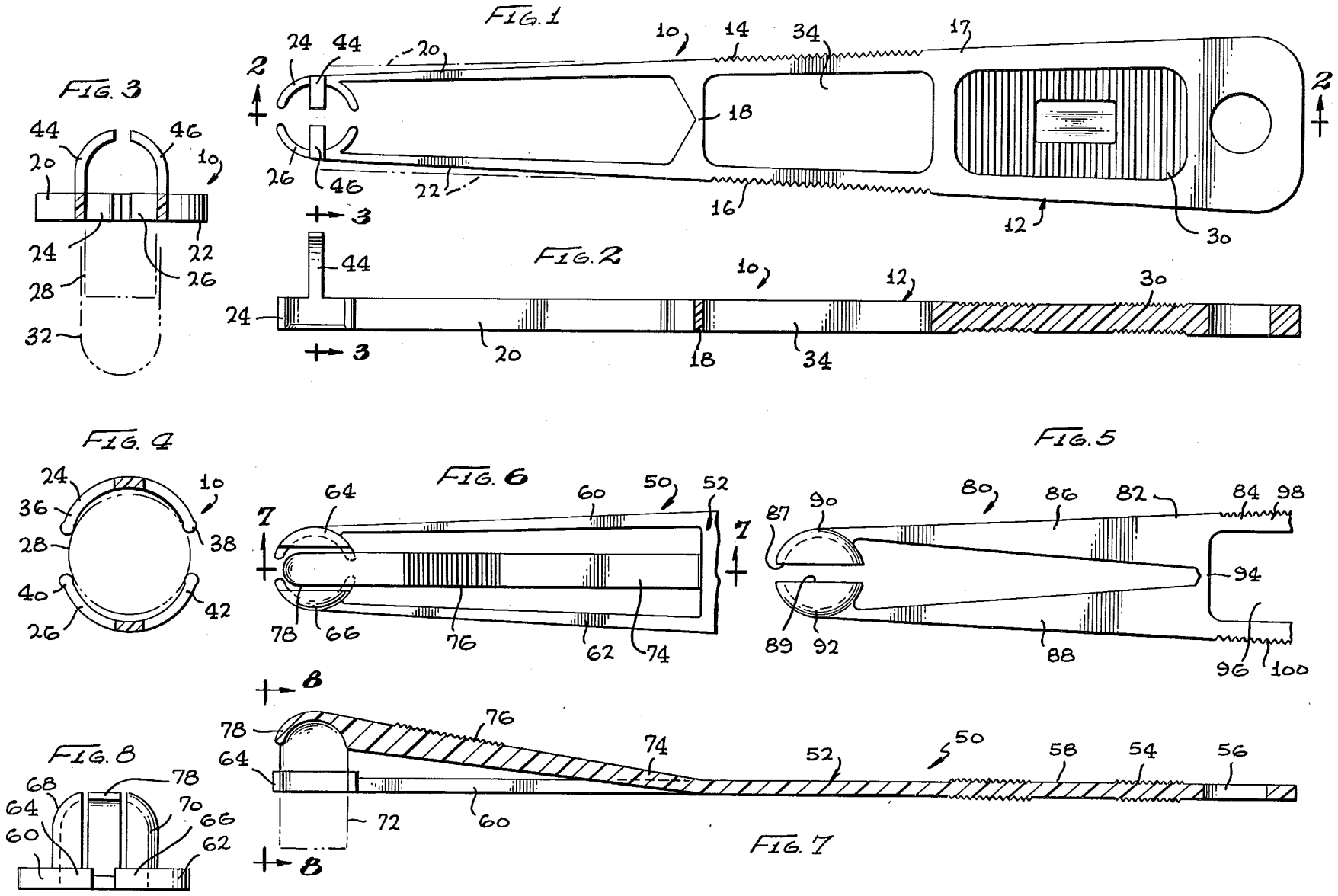
FIG. 1 is a plan view of the first preferred embodiment of the gelatin capsule holder of this invention.
FIG. 2 is a longitudinal section therethrough, taken generally along the line 2—2 of FIG. 1.
FIG. 3 is a section through the jaws, taken generally along the line 3—3 of FIG. 2.
FIG. 4 is an enlarged plan view of the jaws, with parts broken away and parts taken in section.
FIG. 5 is a plan view of the second preferred embodiment of the gelatin capsule holder of this invention with parts broken away.
FIG. 6 is a plan view of the third preferred embodiment of the gelatin capsule holder of this invention, with parts broken away.
FIG. 7 is a longitudinal section therethrough, taken generally along the line 7—7 of FIG. 6.
FIG. 8 is an end-elevational view of the jaws of gelatin capsule holder of FIGS. 6 and 7, as seen generally from along the line 8—8 of FIG. 7.

The first preferred embodiment of the gelatin capsule holder of this invention is shown in FIGS. 1, 2, 3 and 4 and is indicated at 10 in FIGS. 1 and 2. Gelatin capsule holder 10 has a body 12 which extends forward past finger grips 14 and 16 on handle end 17 to the forward joining of the two sides of the body at flexure hinge 18. Arms 20 and 22 extend past flexure hinge 18. Jaws 24 and 26 are respectively formed on the ends of arms 20 and 22. The jaws are of such dimension, discussed in further detail below, as to grasp an open half of a gelatin capsule, such as the capsule half 28 shown in FIGS. 3 and 4.

When positioned in that way, the grip portion 30 on the handle end 17 of body 12 of gelatin capsule holder 10 is grasped between thumb and forefinger, and the capsule half 28 is scooped through the powder or small pellet material to be capsulized, so that the capsule half is filled. Thereupon, the capsule cover 32 is put in place (usually manually) in the small volume operations for which the gelatin capsule holder 10 is intended. Release of the now filled and covered capsule is accomplished by squeezing on the finger grips 14 and 16. Opening 34 between the finger grips permits them to be squeezed together, thereupon hinging the arms around flexure hinge 18 so that arms 20 and 22 separate to separate the jaws 24 and 26 to the dotted line position shown in FIG. 1 to release the capsule, which falls out. The gelatin capsule holder 10 is made of resilient material to permit this action. An injection-moldable, plastic synthetic polymer composition material of proper resiliency is preferred because of the inexpensive manufacturing, and an example of a particular such material is Delrin 500.

The shape of jaws 24 and 26 is important to provide for proper insertion of the capsule half 28, proper holding thereof, and proper release of the filled and covered capsule. As seen in FIG. 4, jaw 24 comprises fingers 36 and 38 which extend in a circular arc, somewhat less than 180 degrees. The center of curvature of the arc formed by the fingers is smaller than the capsule diameter which is intended to be held. The conventional capsule diameter of capsules of ordinary size ranges from about 0.245 inch to about 0.312 inch, and thus the radius of curvature of the arc is slightly less than 0.245 inch. The ends of the fingers are rounded in order to prevent gouging of the capsule half retained in the jaws. Similarly, jaw 26 has fingers 40 and 42 which are also arranged in a circular arc on the same radius as the arc formed by fingers 36 and 38. Fingers 40 and 42 are also rounded at the ends.

The resiliency of arms 20 and 22, as well as the fingers and the jaws, is such that a capsule half can be forced into the jaws without squeezing the jaws open, although, of course (especially for the larger capsule diameters), the jaws can be squeezed open to aid insertion of the capsule. Stops 44 and 46 are formed as part of the jaws 24 and 26, respectively. The stops extend upward from the jaws away from the open side of the capsule half and are curved over the jaws at the approximate radius of the back, closed end of the capsule half to act as a stop for the closed end of the capsule half 28. In this way, when the capsule half is forced into the jaws, it engages against the stops 44 and 46 so that it is not thrust through the jaws during the capsule half filling/scooping operation or during the installation of the capsule cover 32.

Gelatin capsule holder 80 illustrated in FIG. 5 is the second preferred embodiment of the holder of this invention. It comprises body 82 which has a handle end 84. Body 82 also has arms 86 and 88 extending forward away from the handle end to form a bifurcated forward end. Jaws 90 and 92 are respectively formed on arms 86 and 88. Jaws 90 and 92 are the same as jaws 24 and 26 so that they are in the form illustrated in FIGS. 1–4, with rounded capsule-shaped stops 87 and 89.

Capsule holder 80 is unitarily formed of a resilient material, the same as capsule holder 10. It is also formed with flexure hinge 94 at the base of the bifurcated jaws with the other side of the hinge being defined by central opening 96. Another difference between capsule holder 80 and capsule holder 10 is the fact that the arms 86 and 88 have more material at the hinge end away from the jaws. This provides more beam strength to the arms so that bending is limited along the length of the jaws. Finger grips 98 and 100 are located over opening 96 so that manual force on the finger grips causes squeezing of the body together at opening 96, which causes separation of arms 86 and 88 to release the gelatin capsule from the jaws, as described in respect to the first preferred embodiment illustrated in FIGS. 1–4. Gelatin capsule holder 80 is molded with sufficient resiliency so that the resiliency retains the capsule so that no manual closing force is required for retaining the capsule in the jaws.

With this structure, the capsule half is placed in position, and the resiliency of the body 82 of gelatin capsule holder 80 is sufficient to hold the capsule in place in jaws 90 and 92. The handle end 84 of the body is held between the fingers during manual scoop-filling, the other capsule half is put in place (usually manually in small-scale operations) so that the filled capsule is ready for release. Finger grips 98 and 100 are manually pressed together causing flexure of the body of hinge 94 for the separation of arms 86 and 88 and release the capsule from jaws 90 and 92.

The handle end 84 of body 82 is the same as the handle end 17 of body 10 and the same as the handle end of the gelatin capsule holder 50 described below. Holder 80 is made of synthetic polymer composition material of flexible nature and preferably of injection-moldable composition. Delrin 500 is an example of a suitable material.

Gelatin capsule holder 50 illustrated in FIGS. 6, 7 and 8 is the third preferred embodiment of the holder of this invention. Holder 50 has a body 52 which is generally flat and has a grip portion 54 on the upper end thereof by which the holder 50 can be manually grasped between the thumb and forefinger. Hole 56 is formed through the body to permit holder 50 to be hung up when out of use, and indicia panel 58 is provided for identification marking. Similar structures are formed on holders 10 and 80.

Arms 60 and 62 extend forward from body 52 and carry jaws 64 and 66, respectively, on the outer ends thereof. As seen in FIG. 6, jaws 64 and 66 are each formed of curved fingers, similarly to the jaws 24 and 26, and the fingers of jaws 64 and 66 are dimensioned the same as the jaws of the first preferred embodiment of holder 10. However, in the case of holder 50, stops 68 and 70 extending upwardly from the jaws are more in the shape of a segment of a cylinder, approximately 90 degrees of the cylinder. The tops of the stops 68 and 70 are formed as segments of a sphere. These shapes generally correspond to the outer surface of the capsule half 72 (see FIG. 7) to be held therein, but the cylindrical portions are on the radius slightly smaller than the radius of the capsule half. In this way, when the capsule half is embraced in the jaws, it is not only retained by the fingers of the jaws, but is also retained by the partially cylindrical and partially spherical portions of the stop. At it is held in this way, the capsule half can be filled by scooping it through the powder or pelletized material with which it is to be filled. Scooping is accomplished by manual engagement of the body of holder 50 so that the fingers need not engage in the filling material. After the capsule cover is installed on capsule half 72, then the completed capsule can be removed from holder 50.

Ejector lever 74 is integrally formed as part of the body 52 and extends forward between arms 60 and 62, as seen in FIGS. 6 and 7, and is positioned above the arms 60 and 62 in the non-stressed position. Ejector lever 74 has finger grip 76 on the upper surface thereof beyond the juncture of ejector lever 74 with body 52. Ejector lever 74 carries capsule-engaging cup 78 on its end. Cup 78 is positioned even with the opening between stops 68 and 70. After the capsule half is filled and capped, then the capsule is ejected from holder 50 by manual depression of ejector lever 74 to displace the capsule from between jaws 64 and 66 and thus release the capsule from holder 50.

Holder 50 is also made of resilient material, preferably an injection-moldable thermoplastic synthetic polymer composition material, of which Delrin 500 is an example. The arms 60 and 62 and the jaws carried thereon are resilient and positioned to resiliently engage a conventional capsule, for example those having a diameter range from about 0.245 inch to 0.312 inch without need for manual spreading apart of arms 60 and 62 during insertion of the capsule half or squeezing together of those arms to retain the capsule in position during the filling operation. Thus, the capsule is held sufficiently firmly in holder 50 to permit the capsule to be filled by scooping it through the filling material.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A holder for holding a portion of a gelatin capsule for the filling thereof, said holder comprising:

a body for manual engagement;

first and second arms integrally formed with and extending forward from said body;

first and second jaws respectively formed on said first and second arms, said first and second jaws cooperating with each other and being shaped to engage and retain a portion of a gelatin capsule therebetween, said holder being formed of resilient material so that said arms and said jaws can be positioned to resiliently retain the capsule portion in said jaws so that, by manual operation of said holder, the capsule portion can be scooped through material for filling the capsule portion; and release means comprising an ejector lever mounted on said body and extending above said jaws so that, upon resilient deflection of said ejector lever, the capsule portion is ejected from between said jaws.

2. The holder of claim 1 wherein a capsule stop is secured to at least one of said jaws and is positioned above said jaws so that the capsule portion can be inserted a predetermined distance into said jaws whereupon it engages said stop.

3. The holder of claim 2 wherein said ejector lever is positioned above said stop in the undeflected position of said ejector lever so that the gelatin capsule portion rests against said stop until said ejector lever is deflected to eject the gelatin capsule portion from said jaws.

4. The holder of claim 3 wherein both of said jaws have a pair of fingers thereon each being in an arcuate segment and each having substantially the same radius of curvature, the radius being smaller than the radius of the capsule portion, said fingers being directed toward each other for engaging the capsule portion therebetween.

5. A one-piece holder integrally formed of a resilient plastic synthetic polymer composition material for holding a portion of a gelatin capsule for the filling thereof, said holder comprising:

a rear handle end;

a pair of arms substantially parallel to each other and extending forward from said handle end, each of said arms having a finger grip portion adjacent said handle end and then having a cantilever portion extending forward from said finger grip portion to form a bifurcated front end;

a flexure hinge joining said arms at the forward ends of their finger grip portions whereby manual squeezing of said finger grip portions toward each other causes said cantilever portions to openly diverge;

each of said cantilever portions having a forward jaw end, a jaw formed on each of said jaw ends cooperating with each other and being shaped to engage and retain a portion of a gelatin capsule therebetween, each of said jaws comprising a pair of fingers forming an arcuate segment tangential to said jaw end of said cantilever portion and defining a substantially circular bottom opening for receiving such gelatin capsule portion, each said jaw having a stop portion extending upward and parallel to each other above said fingers and then curved toward each other so as to face each other and cooperatively form a rounded configuration substantially matching the closed end of the capsule portion to retain said capsule portion within said jaws during capsule filling operations, said jaws being normally spaced apart a distance barely less than the width of such capsule so that, when holding such capsule therebetween, said arms impose on said jaws a non-crushing force with respect to said capsule.

6. The holder of claim 5 further including release means and said release means comprises an ejector lever mounted on said body and extending above said jaws so that, upon resilient deflection of said ejector lever, the capsule portion is ejected from between said jaws.

7. The holder of claim 6 wherein said ejector lever is positioned above said stop in the undeflected position of said ejector lever so that the gelatin capsule portion rests against said stop until said ejector lever is deflected to eject the gelatin capsule portion from said jaws.

* * * * *